US007822167B2

(12) United States Patent
Trubnikow

(10) Patent No.: US 7,822,167 B2
(45) Date of Patent: Oct. 26, 2010

(54) NUCLEAR FACILITY AND METHOD FOR OPERATING A NUCLEAR FACILITY

(75) Inventor: Wladimir Trubnikow, Offenbach (DE)

(73) Assignee: Areva NP GmbH, Erlangen (DE)

( * ) Notice: Subject to any disclaimer, the term of this patent is extended or adjusted under 35 U.S.C. 154(b) by 614 days.

(21) Appl. No.: 11/268,230

(22) Filed: Nov. 7, 2005

(65) Prior Publication Data

US 2007/0017167 A1 Jan. 25, 2007

Related U.S. Application Data

(63) Continuation of application No. PCT/EP2004/004734, filed on May 4, 2004.

(30) Foreign Application Priority Data

May 5, 2003 (DE) ..... 103 20 100

(51) Int. Cl.
*G21C 9/00* (2006.01)

(52) U.S. Cl. ..... 376/461; 376/277; 376/280; 52/98; 52/79.4; 52/167.3

(58) Field of Classification Search ..... 52/167.3, 52/169.11, 98, 79.4, 36.1, 79.1; 376/463, 376/285, 294, 461, 277, 280, 286, 302, 303
See application file for complete search history.

(56) References Cited

U.S. PATENT DOCUMENTS

| | | | | | |
|---|---|---|---|---|---|
| 700,378 | A | * | 5/1902 | Schmidt | 285/64 |
| 2,256,493 | A | * | 9/1941 | Ragsdale et al. | 105/1.1 |
| 2,282,354 | A | * | 5/1942 | Gunn | 285/229 |
| 3,716,451 | A | * | 2/1973 | Van Sickel et al. | 376/461 |
| 3,916,944 | A | * | 11/1975 | Crawford et al. | 137/376 |
| 4,064,005 | A | * | 12/1977 | Baujat | 376/461 |
| 4,090,826 | A | | 5/1978 | Hinzmann | |
| 4,629,601 | A | * | 12/1986 | Blaushild | 376/463 |
| 4,654,191 | A | * | 3/1987 | Krieg | 376/283 |
| 4,688,628 | A | * | 8/1987 | Moldenhauer | 165/67 |
| 4,832,305 | A | * | 5/1989 | Asmundsson | 248/636 |
| 4,940,025 | A | * | 7/1990 | Ott et al. | 122/510 |

(Continued)

FOREIGN PATENT DOCUMENTS

DE 24 26 557 8/1975

(Continued)

OTHER PUBLICATIONS

International Search Report, dated Oct. 10, 2004.

*Primary Examiner*—Phi Dieu Tran A
(74) *Attorney, Agent, or Firm*—Laurence A. Greenberg; Werner H. Stemer; Ralph E. Locher

(57) ABSTRACT

A technical installation, especially a nuclear power plant, has a number of system components that are respectively supported by a number of beams, and a number of pressurized conduits. The technical installation is designed in such a way that secondary damage occurring in the surroundings of pressurized conduits are kept particularly low even if the pressurized conduits rupture. This is achieved in that at least one of the beams is embodied in a segmented manner in an area that is expected to be affected if a pressurized conduit ruptures, adjacent segments preferably being connected to each other via screw connections.

11 Claims, 2 Drawing Sheets

U.S. PATENT DOCUMENTS

| | | | | |
|---|---|---|---|---|
| 5,024,804 | A * | 6/1991 | Blaushild | 376/285 |
| 5,217,681 | A * | 6/1993 | Wedellsborg et al. | 376/294 |
| 5,278,880 | A * | 1/1994 | Baker et al. | 376/285 |
| 5,544,210 | A * | 8/1996 | Wedellsborg | 376/294 |
| 5,660,007 | A * | 8/1997 | Hu et al. | 52/167.3 |
| 6,012,256 | A | 1/2000 | Aschheim | |
| 6,768,421 | B1 * | 7/2004 | Alioto et al. | 340/600 |
| 7,213,790 | B2 * | 5/2007 | Bailey et al. | 248/65 |

FOREIGN PATENT DOCUMENTS

| | | | |
|---|---|---|---|
| DE | 29 20 068 | | 11/1980 |
| DE | 32 40 599 | A1 9 | 3/1984 |
| DE | 32 40 599 | A1 | 5/1984 |
| DE | 196 49 923 | A1 | 6/1998 |
| DE | 197 33 149 | A1 | 2/1999 |
| DE | 200 16 088 | U1 | 3/2001 |
| DE | 101 32 203 | C1 | 10/2002 |
| EP | 0 928 851 | A1 | 7/1999 |
| FR | 2 588 698 | | 4/1987 |
| JP | 52094008 | A | 8/1977 |
| JP | 52152418 | A | 12/1977 |
| JP | 53059100 | A | 5/1978 |
| JP | 02042166 | A | 2/1990 |
| JP | 03221637 | A | 9/1991 |
| JP | 2003013621 | A | 1/2003 |

* cited by examiner

NUCLEAR FACILITY AND METHOD FOR OPERATING A NUCLEAR FACILITY

BACKGROUND OF THE INVENTION

Field of the Invention

The invention relates to a technical installation with a number of system components supported in each case by a number of girders and with a number of pressure-carrying lines. It relates especially to a nuclear power plant.

In many technical plants, especially nuclear power plants, pressure-carrying lines may be used, for example for carrying a flow medium. Depending on the design characteristic of the respective technical installation, the selected design pressure of the flow medium carried in such lines may be very high, and therefore, in the event of the mechanical failure of the lines or of individual line elements, a considerable mechanical load on the immediate vicinity of the respective lines may occur. In order to make an accident scenario easy to handle in such situations, the pressure-carrying lines may be provided, in particular, with what may be referred to as failure fixed points, so that, in the event of mechanical failure, at least the location and the immediate vicinity of an accident can be planned and therefore can be controlled.

In the event of a mechanical failure of such a line provided, in particular, with a predetermined breaking point, which may lead, in particular, to a complete pipe break, the pipe ends which are free after the pipe break may be exposed to considerable mechanical deformations as a result of the possibly high design pressure of the flow medium carried in the lines and may in this case act with considerable forces on surrounding components, "beating pipe ends", as they may be referred to. This may lead, in particular, to the partial or complete destruction of system components arranged in the vicinity of the pressure-carrying lines. Particularly in the case where system components are supported in the vicinity of the pressure-carrying lines via a number of girders, as may be provided particularly with regard to operating or access platforms, as they are known, the action of such a pipe end which has been freed on one or some of the girders may lead, due to the deformation transferred via these, even to the destruction of the respective system component, in which case the latter may itself involve further components, such as, for example, further pressure lines or measuring lines, which are arranged in its vicinity. Consequently, in an accident caused by the mechanical failure of a pressure-carrying line, comparatively serious secondary damage to further system components may occur beyond its immediate vicinity.

SUMMARY OF THE INVENTION

The object on which the invention is based, therefore, is to specify a technical installation of the abovementioned type, which is protected to an especial extent against further damage to system components even in the event of a mechanical break of a pressure-carrying line.

This object is achieved, according to the invention, in that at least one of the girders has a segmented design in a target region expected in the event of a pipe break in a pressure-carrying line.

The invention proceeds, in this context, from the consideration that the overall damage to be expected in the event of a pipe break in a pressure-carrying line can be kept particularly low, in that the transfer of the forces and deformations of system components, transmitted by the beating pipe ends in the event of a pipe break, to further system components is as far as possible prevented. An especially suitable starting point for such a prevention of the transfer of introduced forces is girders, such as, for example, steel girders, used for supporting the system components. For example, in the case of a beating pipeline of a high-pressure system, the impingement of a freed pipeline end onto a girder of this type may lead to the deformation of the system component as a whole, which is supported overall by the girder, so that an unwanted transfer of the forces and constrained routes also into further components, such as, for example, pipelines or measuring lines, could proceed via this system component. In order, therefore, to prevent the transmission of the forces from the girders into the respective system component, the girders are designed, at least in an expected target region capable of being delimited, in particular, by analysis of the predetermined breaking points possibly provided, in such a way that, instead of a transfer of the introduced forces, an avoidance of individual system parts is possible. For this purpose, the respective girders have a segmented design in the manner of adapter pieces in the expected target region, so that, if required, individual segments can be knocked out from the freed pipeline end, without secondary effects on the adjacent segments or, for example, on the system component as a whole being capable of occurring.

Advantageously, adjacent segment of the or each girder of segmented design are in this case connected to one another in such a way that the connection points can be loaded at most with a predetermined limiting shear force. What can be achieved thereby is that, normally, that is to say without bursting or beating pipelines, the girder still has, overall, a sufficient load-bearing force and can therefore be used in the functionally appropriate way. If, however, the accident, to be precise a pipeline break, then to be treated in design-related terms, occurs, with a freed line end acting upon the respective girder, then, as a result of the forces which act on the respective segment in this case by virtue of the design pressure of the entrained flow medium and which lead to shear forces at the connection points, the consequence is that the respective adapter piece or middle segment is knocked out. The limiting shear force provided for maximum load is in this case therefore expediently selected below the shear force at the connection points which is to be expected in such an accident.

An especially simple possibility for mounting such a girder structure selected to be segmented can be achieved, in that adjacent segments of the or each girder of segmented design are connected to one another advantageously via screw connections. In order in this case, if required, that is to say for a freed pipeline end to butt against the respective segment in a way provided in design-related terms, to ensure that this segment is reliably released from the overall composite structure, the connecting screws of the or each screw connection are advantageously guided in a number of long holes. These make it possible to release the respective segment in an especially reliable way, in that, in a further advantageous embodiment, the or each long hole is designed to be open in a direction of avoidance expected in the event of an impingement of a line component onto the respective segment. The long holes provided in this way ensure, in particular, that, in the event of release, there are sufficiently free routes, so that there is no substantial influence exerted on the continuous process or on the tied systems. The functioning capacity of the connection is in this case expediently ensured by correspondingly dimensioned screws with a corresponding shank for transmitting the transverse forces limited in this way. For this purpose, if required, a controlled prestressing of the structure, in particular by means of spring rings, may expediently also be provided.

In a particularly advantageous embodiment, the girders of segmented design, provided according to the invention, are used in a nuclear power plant. In this case, in particular, there may be provision for providing system fittings, not safety-relevant as such, within the pressure vessel or the outer jacket of the nuclear power plant with girders of this type. Advantageously, in this case, an access or operating platform is designed as a system component supported by a number of girders segmented in this way. To be precise, it is exactly on the access or operating platforms normally provided in a nuclear power plant where a multiplicity of measuring or test lines may be led along, which, in the event of the destruction of the respective platform, could likewise be torn off in the manner of secondary damage. A protection of lines of this type is possible in an especially effective way, in that it is exactly the girders provided for supporting such platforms which have a segmented design in the expected target regions.

The advantages achieved by means of the invention are, in particular, that, owing to the segmented design of girders for system components, even in the event of a line break with freed pipeline ends, a transfer of the forces thus released and of routes into components located at a greater distance is reliably ruled out in the nearby region or vicinity of pressure-carrying lines. To be precise, this segmented design of the girders ensures that, in the event of an impact, the respective segment is merely knocked out of the girder, without a deformation of the system component as a whole, supported by the girders, along with secondary damage correspondingly to be expected, being capable of occurring in this situation. Thus, the steel structure as a whole does not experience any significant plastic deformation which could influence the overall primary load-bearing capacity. Furthermore, consequential breaks in the beating pipeline system are avoided in a controlled way, since no significant kickback into the line system is to be expected in the event of the impingement of the freed line ends onto the respective girder. Furthermore, on account of the segmented design of the girders, special anchorages, special structures or shock-absorber elements may be dispensed with, even in a system design meeting stringent safety requirements, thus resulting, in particular, in simple retrofitting possibilities.

An exemplary embodiment of the invention is explained in more detail with reference to a drawing in which:

BRIEF DESCRIPTION OF THE DRAWINGS

Identical parts are given the same reference symbols in all the figures.

DESCRIPTION OF THE PREFERRED EMBODIMENTS

Figure 1:
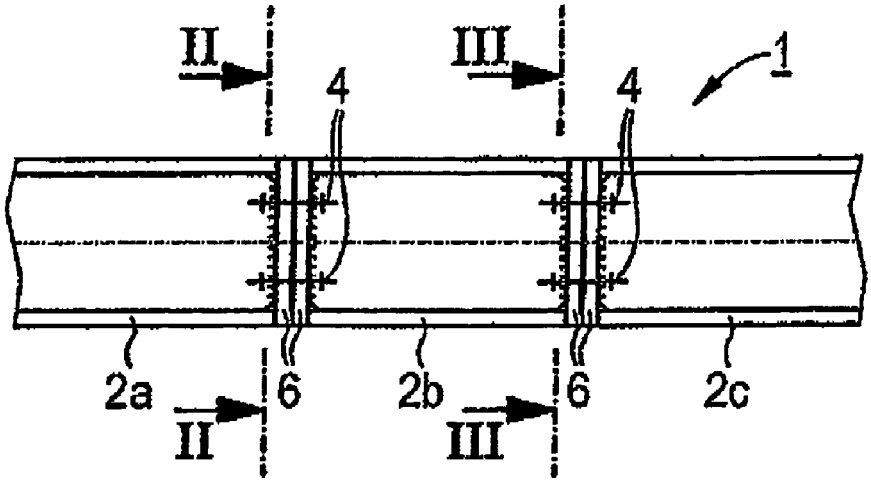
FIG. 1 shows a girder of segmented design for a system component in a nuclear power plant.

The girder 1 according to FIG. 1 is provided for supporting an operating or access platform, not illustrated in any more detail, in a nuclear plant 12. An operating or access platform of this type is arranged within the reactor building, in order, as required, to give the operating personnel possibilities for movement at the corresponding points. Furthermore, an operating or access platform of this type is normally also used for the routing and retention of measuring or other operating lines arranged on it.

Furthermore, the girder 1 is arranged in the vicinity of pressure-carrying lines 16 of the high-pressure system of the nuclear power plant 12. Consequently, in the event of a pipe break 18 in the pressure-carrying system, beating pipe ends, as they may be referred to, could occur, which could act with considerable forces on components located in their vicinity. The girder 1 is designed with the aim, in the event of such an accident, of strictly preventing the transfer of the introduced forces and constrained routes into the operating or access platform and, via this, into further lines arranged on it and thus of keeping secondary damage particularly low even in the event of a pipe break 18 in the pressure-carrying system of the nuclear power plant 12.

For this purpose, the girder 1 has a segmented design and comprises, as seen in its longitudinal direction, a number of successively arranged segments 2*a*, 2*b*, 2*c* connected to one another at their connection points. This segmented design of the girder 1 is in this case selected such that, in the event of a pipe break in the pressure-carrying system, the middle segment 2*b* can be knocked comparatively easily out of its position between the segments 2*a* and 2*c*. The girder 1 is thus designed in the manner of an avoidance system, so that, even in the event of the impingement of a freed pipeline end onto the segment 2*b*, a transfer of forces into the segments 2*a* and 2*c* adjacent to this is avoided. Adjacent segments 2*a*, 2*b*, 2*c* of the girder 1 of segmented design are in this case connected to one another in such a way that the connection points can be loaded at most with a predetermined limiting shear force which is selected below the actually occurring shear force expected for such a pipe break.

Adjacent segments 2*a*, 2*b*, 2*c* of the girder 1 of segmented design are in this case connected to one another via screw connections 4.

Figure 2:
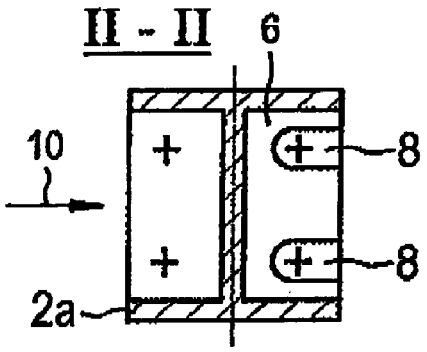
FIG. 2 shows the girder according to FIG. 1 in cross section.
Figure 3:
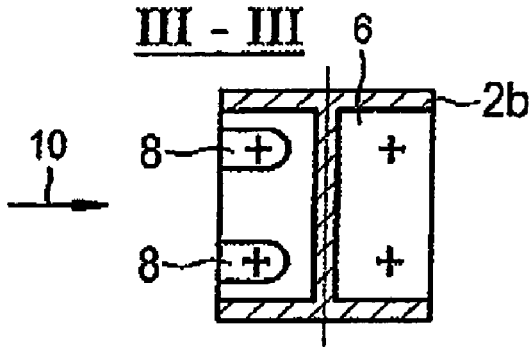
FIG. 3 shows the girder according to FIG. 1, likewise in cross section.

The girder 1 is shown in the region of its first segment 2*a* in FIG. 2 and in the region of its middle segment 2*b* in FIG. 3, in each case in cross section. As may be gathered from these illustrations, the end flanges 6 provided for making the connection between adjacent segments 2*a*, 2*b*, 2*c* are provided with long holes 8 for receiving the connecting screws of the screw connections 4. The long holes 8 are in this case designed to be kept open in such a way that, in the event of the impingement of a freed pipe end, they allow a comparatively unimpeded avoiding movement of the middle segment 2*b* in an expected direction of avoidance indicated by the arrow 10. For this purpose, as shown in FIG. 2, the long holes 8 arranged in the end flange 6 of the first segment 2*a* are designed to be open at their rear end, as seen in terms of the expected direction of impingement of the pipeline end, in order thereby to allow an unimpeded emergence of the screws in the direction of avoidance. Furthermore, as can be seen in FIG. 3, the front long holes 8 of the connecting flange 6 of the middle segment 2*b*, as seen in terms of the expected direction of impingement of the pipeline end, are designed to be open, so that, here too, an unimpeded emergence of the connecting screws guided therein is possible in the event of the impingement of the free pipeline end.

Figure 4:
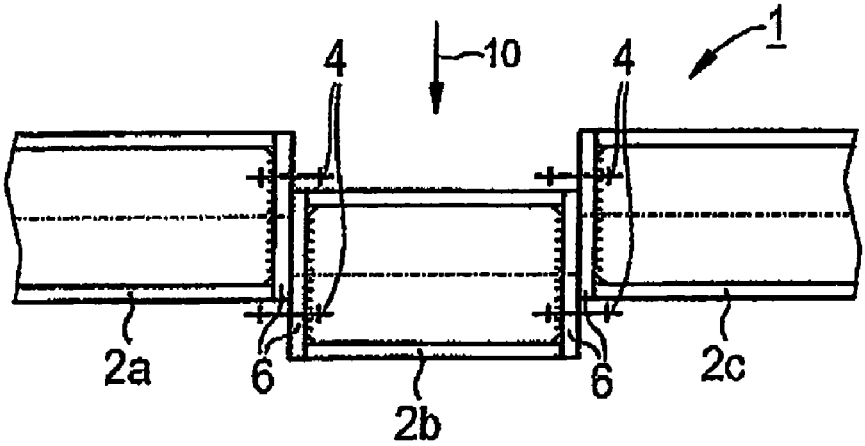
FIG. 4 shows the girder according to FIG. 1 after the impingement of a freed pipeline end.

FIG. 4 shows the final state which can be reached as a result of this segmented design of the girder 1 after the impingement of a freed pipeline end. The middle segment 2*b* of the girder 1 is displaced with respect to its adjacent segments 2*a*, 2*c*, as seen in the expected direction of impingement, represented by the arrow 10, of a freed pipeline end. The introduced force is thus converted into a displacement of the segment 2*b*, without a transfer of forces into the adjacent segments 2*a*, 2*c* or a deformation of the girder 1 as a whole and consequently also of the system component or operating platforms supported by it taking place.

Figure 5:
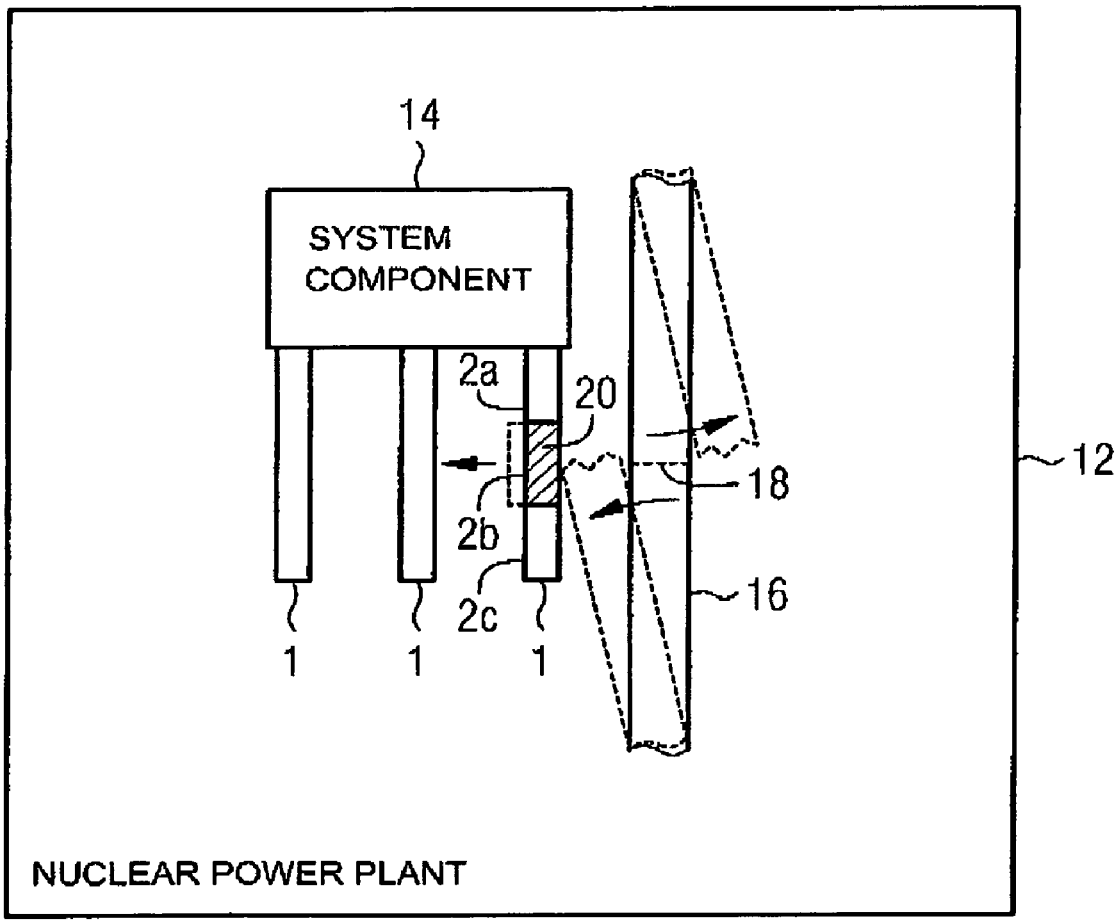
FIG. 5 shows a technical plant with the girder.

FIG. 5 shows a nuclear power plant 12 with a plurality of girders 1 supporting a system component 14, such as, for example, an operating or access platform. One of the pressure-carrying lines 16 of the high-pressure system has a pipe break 18, which causes the broken ends of the pressure-carrying line 16 to beat against the target region 20 of one of the plurality of girders 1.

LIST OF REFERENCE SYMBOLS

1 Girder
2*a*, 2*b*, 2*c* Segment
4 Screw connection
6 End flange
8 Long hole
10 Arrow

I claim:

1. A technical installation, comprising: a plurality of system components, a plurality of girders supporting said system components, and a plurality of pressure-carrying lines, said girders having a defined target region at which impact is expected in an event of a pipe break of one of said pressure-carrying lines, and said girders having a segmented configuration in said target region, wherein said defined target region has a predetermined breaking point that is designed to break when subjected to a force that is lower than a force subjected to said defined target region by a broken one of said pressure-carrying lines.

2. The technical installation according to claim 1, wherein adjacent segments of said girder or of each of said girders having said segmented configuration are connected to one another with connection points thereof being rated for a load defined with a predetermined threshold shear force.

3. The technical installation according to claim 1, wherein adjacent segments of said girder or of each of said girders having said segmented configuration are connected to one another via screw connections.

4. The technical installation according to claim 3, wherein said segments are formed with a plurality of elongated holes, and connection bolts of said screw connections are guided in said elongated holes.

5. The technical installation according to claim 4, wherein said elongated holes are formed as open slots with openings in a direction of avoidance expected in the event of an impingement of a pressure-carrying line onto the respective said segment.

6. The technical installation according to claim 1 configured as a nuclear power plant.

7. The technical installation according to claim 6, wherein said nuclear power plant includes an access or operating platform forming a system component supported by said plurality of segmented girders.

8. A technical installation, comprising:

a plurality of system components, a plurality girders supporting said system components, and a plurality of pressure-carrying lines;

at least some of said girders including a plurality of segments in a target region at which an impact is expected in an event of a pipe break of one of said pressure-carrying lines;

at least some of said girders including a plurality of connection regions releasably connecting an intermediate one of said plurality of segments to adjacent ones of said plurality of segments such that if the impact occurs, the impact displaces said intermediate one of said plurality of segments away from said adjacent ones of said plurality of segments in a manner such that said adjacent ones of said plurality of segments are not damaged;

wherein said plurality of connection regions has a predetermined breaking point that is designed to break when subjected to a force that is lower than a force subjected to said target region by a broken one of said pressure-carrying lines.

9. The technical installation according to claim 8, wherein the plurality of connection regions withstand a maximum predetermined limiting shear force that is less than a force expected to be caused by the pipe break.

10. The technical installation according to claim 8, wherein the plurality of connection regions include cooperating holes and screws.

11. The technical installation according to claim 1, wherein said segmented configuration includes a middle segment that is designed with said predetermined breaking point.

* * * * *